US011501707B2

(12) United States Patent
Yu et al.

(10) Patent No.: US 11,501,707 B2
(45) Date of Patent: Nov. 15, 2022

(54) PIXEL CIRCUIT AND DRIVING METHOD THEREOF, DISPLAY DEVICE AND DRIVING METHOD THEREOF

(71) Applicants: Chengdu BOE Optoelectronics Technology Co., Ltd., Sichuan (CN); BOE Technology Group Co., Ltd., Beijing (CN)

(72) Inventors: Ziyang Yu, Beijing (CN); Zhu Wang, Beijing (CN); Sheng Hu, Beijing (CN); Tianliang Liu, Beijing (CN); Guo Liu, Beijing (CN)

(73) Assignees: CHENGDU BOE OPTOELECTRONICS TECHNOLOGY CO., LTD., Sichuan (CN); BEIJING BOE TECHNOLOGY DEVELOPMENT CO., LTD., Beijing (CN)

( * ) Notice: Subject to any disclaimer, the term of this patent is extended or adjusted under 35 U.S.C. 154(b) by 0 days.

(21) Appl. No.: 17/260,746

(22) PCT Filed: Mar. 31, 2020

(86) PCT No.: PCT/CN2020/082569

§ 371 (c)(1),
(2) Date: Jan. 15, 2021

(87) PCT Pub. No.: WO2021/196015

PCT Pub. Date: Oct. 7, 2021

(65) Prior Publication Data

US 2022/0108655 A1 Apr. 7, 2022

(51) Int. Cl.
*G09G 3/3233* (2016.01)
*G09G 3/3258* (2016.01)

(52) U.S. Cl.
CPC ..... *G09G 3/3233* (2013.01); *G09G 3/3258* (2013.01); *G09G 2300/0819* (2013.01);
(Continued)

(58) Field of Classification Search
CPC ..... G09G 3/3233; G09G 3/3258; G09G 2300/0819; G09G 2310/061;
(Continued)

(56) References Cited

U.S. PATENT DOCUMENTS

| | | | | |
|---|---|---|---|---|
| 9,947,269 | B2 | 4/2018 | Jung et al. | |
| 2012/0139961 | A1 | 6/2012 | Choi | |
| 2013/0162617 | A1* | 6/2013 | Yoon | G09G 3/3291 345/76 |
| 2015/0348464 | A1* | 12/2015 | In | G09G 3/2022 345/82 |
| 2016/0351122 | A1* | 12/2016 | Jung | G09G 3/2085 |
| 2017/0249904 | A1* | 8/2017 | Li | G09G 3/3233 |

(Continued)

FOREIGN PATENT DOCUMENTS

| | | | |
|---|---|---|---|
| CN | 106205486 | A | 12/2016 |
| CN | 109523950 | A | 3/2019 |

(Continued)

OTHER PUBLICATIONS

International Search Report dated Dec. 24, 2020, issued in counterpart Application No. PCT/CN2020/082569. (4 pages).

*Primary Examiner* — Tom V Sheng
(74) *Attorney, Agent, or Firm* — WHDA, LLP

(57) ABSTRACT

A pixel circuit includes: pixel units, wherein each pixel unit includes a light-emitting element and a pixel driving circuit, the pixel driving circuit and the light-emitting element are electrically connected to a first node; a first compensation sub-circuit electrically connected to each pixel driving circuit, and configured to provide an initialization signal to the pixel driving circuit, obtain a voltage at the first node when the light-emitting element emits light via the pixel driving circuit, and generate a compensation data signal based on the voltage at the first node; and a second compensation sub-circuit electrically connected to each pixel driving circuit and configured to keep the voltage at the first node within a
(Continued)

set operating voltage range of the light-emitting element. The pixel driving circuit is further configured to initialize the first node based on the initialization signal, and use the compensation data signal to drive the light-emitting element.

17 Claims, 10 Drawing Sheets

(52) U.S. Cl.
CPC ..... *G09G 2310/0251* (2013.01); *G09G 2310/061* (2013.01); *G09G 2310/08* (2013.01); *G09G 2320/0214* (2013.01); *G09G 2320/0233* (2013.01); *G09G 2320/043* (2013.01); *G09G 2320/045* (2013.01)

(58) Field of Classification Search
CPC ..... G09G 2310/08; G09G 2310/0251; G09G 2320/043; G09G 2320/045; G09G 2320/0214; G09G 2320/0233
USPC ..... 345/214
See application file for complete search history.

(56) References Cited

U.S. PATENT DOCUMENTS

| | | | | |
|---|---|---|---|---|
| 2017/0301289 | A1* | 10/2017 | Jeong | G09G 3/3233 |
| 2018/0315374 | A1* | 11/2018 | Zhang | G09G 3/3275 |
| 2018/0342196 | A1* | 11/2018 | Zhou | H01L 27/1214 |
| 2018/0342197 | A1* | 11/2018 | Zhou | G09G 3/32 |
| 2020/0211448 | A1* | 7/2020 | Zhou | G09G 3/32 |
| 2021/0027679 | A1* | 1/2021 | Kwon | G09G 3/006 |
| 2021/0035501 | A1* | 2/2021 | Feng | G09G 3/3283 |
| 2021/0064170 | A1* | 3/2021 | Hwang | G06F 3/0443 |
| 2021/0335232 | A1* | 10/2021 | Jiang | G09G 3/3233 |
| 2021/0366383 | A1* | 11/2021 | Ma | G09G 3/3233 |

FOREIGN PATENT DOCUMENTS

| | | | |
|---|---|---|---|
| CN | 109545146 | A | 3/2019 |
| CN | 109559686 | A | 4/2019 |
| CN | 109817159 | A | 5/2019 |
| CN | 110827757 | A | 2/2020 |
| CN | 111179855 | A | 5/2020 |

* cited by examiner

PIXEL CIRCUIT AND DRIVING METHOD THEREOF, DISPLAY DEVICE AND DRIVING METHOD THEREOF

CROSS-REFERENCE TO RELATED APPLICATION

This application is a Section 371 National Stage Application of International Application N. PCT/CN2020/082569, filed on Mar. 31, 2020, entitled "PIXEL CIRCUIT AND DRIVING METHOD THEREOF, DISPLAY DEVICE AND DRIVING METHOD THEREOF", the whole disclosure of which is incorporated herein by reference.

TECHNICAL FIELD

Embodiments of the present disclosure relate to the field of display technology, in particular to a pixel circuit and a driving method thereof a display device and a driving method thereof.

BACKGROUND

Semiconductor devices, such as organic light-emitting diodes (OLEDs), use a current driving mode for light-emitting display, thus current stability requirements for driving TFTs (DTFTs) and OLED devices are very high. Meanwhile, OLED devices may deteriorate due to device aging after long-term use, resulting, in image quality degradation problems such as afterimages during display.

SUMMARY

Embodiments of the present disclosure provide a pixel circuit and a driving method thereof as well as a display device and a driving method thereof.

According to one aspect of the embodiments of the present disclosure, a pixel circuit is provided, comprising: a plurality of pixel units arranged in a matrix, wherein each pixel unit comprises a light-emitting element and a pixel driving circuit for driving the light-emitting element to emit light, and the pixel driving circuit and the light-emitting element are electrically connected to a first node; a first compensation sub-circuit electrically connected to each pixel driving circuit in each of the plurality of pixel units, wherein the first compensation sub-circuit is configured to provide an initialization signal to the pixel driving circuit, and to obtain a voltage at the first node when the light-emitting element emits light via the pixel driving circuit, and to generate a compensation data signal based on the voltage at the first node; and a second compensation sub-circuit electrically connected to each pixel driving, circuit in each of the plurality of pixel units and configured to keep the voltage at the first node within a set operating voltage range of the light-emitting element, wherein the pixel driving circuit is further configured to initialize the first node based on the initialization signal, and to use the compensation data signal to drive the light-emitting element to emit light.

In some embodiments, the first compensation sub-circuit comprises: a switching sub-circuit configured to receive a first switching signal and a second switching signal, and to output the initialization signal at an output terminal of the switching sub-circuit under the control of the first switching signal and keep the output terminal in a floating state under the control of the second switching signal; a sampling sub-circuit configured to obtain the voltage at the first node while the output terminal is kept in the floating state; and a data compensation sub-circuit configured to generate the compensation data signal based on a preset compensation model and the voltage at the first node.

In some embodiments, the switching sub-circuit comprises a first transistor, a second transistor, and a third transistor, wherein a gate of the first transistor is electrically connected to receive the first switching signal, a first electrode of the first transistor is electrically connected to receive the initialization signal, and a second electrode of the first transistor is electrically connected to a second electrode of the second transistor and serve as the output terminal; a gate of the second transistor is electrically connected to receive the second switching signal, and a first electrode of the second transistor is electrically connected to a first electrode of the third transistor; a gate of the third transistor is electrically connected to receive a sampling control signal, and a second electrode of the third transistor is electrically connected to the sampling sub-circuit.

In some embodiments, the pixel driving circuit comprises: a driving sub-circuit configured to generate a current for causing the light-emitting element to emit light; a light emission control sub-circuit electrically connected to the light-emitting element and the driving sub-circuit, and configured to receive a first control signal and supply a current for causing the light-emitting element to emit light to the light-emitting element under the control of the first control signal; a driving control sub-circuit electrically connected to the driving sub-circuit, and configured to receive the compensation data signal and a second control signal, and to provide the compensation data signal to the driving sub-circuit under the control of the second control signal; and a reset sub-circuit electrically connected to the driving sub-circuit and the first compensation sub-circuit, and configured to receive a third control signal and a fourth control signal, and to apply the initialization signal provided by the first compensation sub-circuit to the first node under the control of the third control signal and the fourth control signal or to output the voltage at the first node when the light-emitting element emits light to the first compensation sub-circuit under the control of the third control signal and the fourth control signal.

In some embodiments, the driving sub-circuit comprises a driving transistor, a fourth transistor and a storage capacitor, wherein a gate of the driving transistor is electrically connected to a first end of the storage capacitor, a drain of the driving transistor and the light emission control sub-circuit are electrically connected to a second node, and a source of the driving transistor and the light emission control sub-circuit are electrically connected to a third node; a gate of the fourth transistor is electrically connected to receive the second control signal, a first electrode of the fourth transistor is electrically connected to the first end of the storage capacitor, and a second electrode of the fourth transistor is electrically connected to the second node; a second end of the storage capacitor is electrically connected to the first node.

In some embodiments, the light emission control sub-circuit comprises a fifth transistor and a sixth transistor, wherein a gate of the fifth transistor is electrically connected to receive the first control signal, a first electrode of the fifth transistor is electrically connected to receive a first voltage signal, and a second electrode of the fifth transistor is electrically connected to the second node; a gate of the sixth transistor is electrically connected to receive the first control signal, a first electrode of the sixth transistor is electrically connected to the third node, and a second electrode of the sixth transistor is electrically connected to the first node.

In some embodiments, the driving control sub-circuit comprises a seventh transistor, a gate of the seventh transistor is electrically connected to receive the second control signal, a first electrode of the seventh transistor is electrically connected to receive the compensation data signal, and a second electrode of the seventh transistor is electrically connected to the third node.

In some embodiments, the second compensation sub-circuit comprises a plurality of compensation capacitors which correspond to respective pixel driving circuits, and a first end of each of the compensation capacitors is electrically connected to the first node, and the second end of each of the compensation capacitors is electrically connected to the gate of the seventh transistor.

In some embodiments, the reset sub-circuit comprises an eighth transistor and a ninth transistor, wherein a gate of the eighth transistor is electrically connected to receive a third control signal, a first electrode of the eighth transistor is electrically connected to the first node, and a second electrode of the eighth transistor is electrically connected to the output terminal of the switching sub-circuit; a gate of the ninth transistor is electrically connected to receive a fourth control signal, a first electrode of the ninth transistor is electrically connected to receive the first voltage signal, and a second electrode of the ninth transistor is electrically connected to the first end of the storage capacitor.

According to another aspect of the present disclosure, a display device comprising the pixel circuit according to the above embodiments is provided.

According to another aspect of the present disclosure, a method for driving a pixel circuit, comprising: compensating a threshold voltage of the pixel driving circuit, so as to eliminate influence of the threshold voltage on a current flowing through the light-emitting element; generating the compensation data signal by using the first compensation sub-circuit; and driving the light-emitting element in each pixel unit to emit light based on the compensation data signal.

In some embodiments, the compensation data signal is generated based on light-emitting brightness of a selected light-emitting element before driving the light-emitting element in each pixel unit to emit light.

In some embodiments, in a process of driving the light-emitting element in each pixel unit to emit light, the compensation data signal is generated based on light-emitting brightness of a light-emitting element in each of selected pixel units or based on the light-emitting brightness of the light-emitting element in each pixel unit.

In some embodiments, generating the compensation data signal by using the first compensation sub-circuit comprises: in a first sampling period, providing a second switching signal, a first control signal, and a third control signal which all have a first level, and providing a first switching signal, a sampling control signal, a second control signal, and a fourth control signal which all have a second level; and in a second sampling period, providing the second switching signal, the sampling control signal, the first control signal, and the third control signal which all have the first level, and providing the first switching signal, the second control signal, and the fourth control signal which all have the second level.

In some embodiments, driving the light-emitting element in each pixel unit to emit light based on the compensation data signal comprises: in a first driving period, providing the first switching signal, the third control signal, and the fourth control signal which all have the first level, and providing the second switching signal, the first control signal, and the second control signal which all have the second level; in a second driving period, providing the first switching signal, the second control signal, and the third control signal which all have the first level, and providing the second switching signal, the first control signal, and the fourth control signal which all have the second level; and in a third driving period, providing the first switching signal and the first control signal which both have the first level, and providing the second switching signal, the second control signal, the third control signal, and the fourth control signal which all have the second level.

According to another further aspect of the present disclosure, a display method by using a display device, comprising: generating the compensation data signal by using the first compensation sub-circuit of the pixel circuit; and driving the light-emitting element in each pixel unit to emit light based on the compensation data signal by using the pixel units of the pixel circuit.

In some embodiments, before driving the light-emitting element in each pixel unit to emit light, the first compensation sub-circuit generates the compensation data signal based on light-emitting brightness of a selected light-emitting element.

In some embodiments, in a process of driving the light-emitting element in each pixel unit to emit light the first compensation sub-circuit generates the compensation data signal based on light-emitting brightness of the light-emitting element in each pixel unit.

BRIEF DESCRIPTION OF THE DRAWINGS

In order to explain technical solutions of the embodiments of the present disclosure more clearly, drawings that need to be used in describing the embodiments of the present disclosure will be briefly introduced below. Obviously, the drawings in the following description are only some embodiments of the present disclosure. For those skilled in the art, other drawings may be obtained based on these drawings without creative work. In the drawings.

DETAILED DESCRIPTION OF EMBODIMENTS

Figure 1:
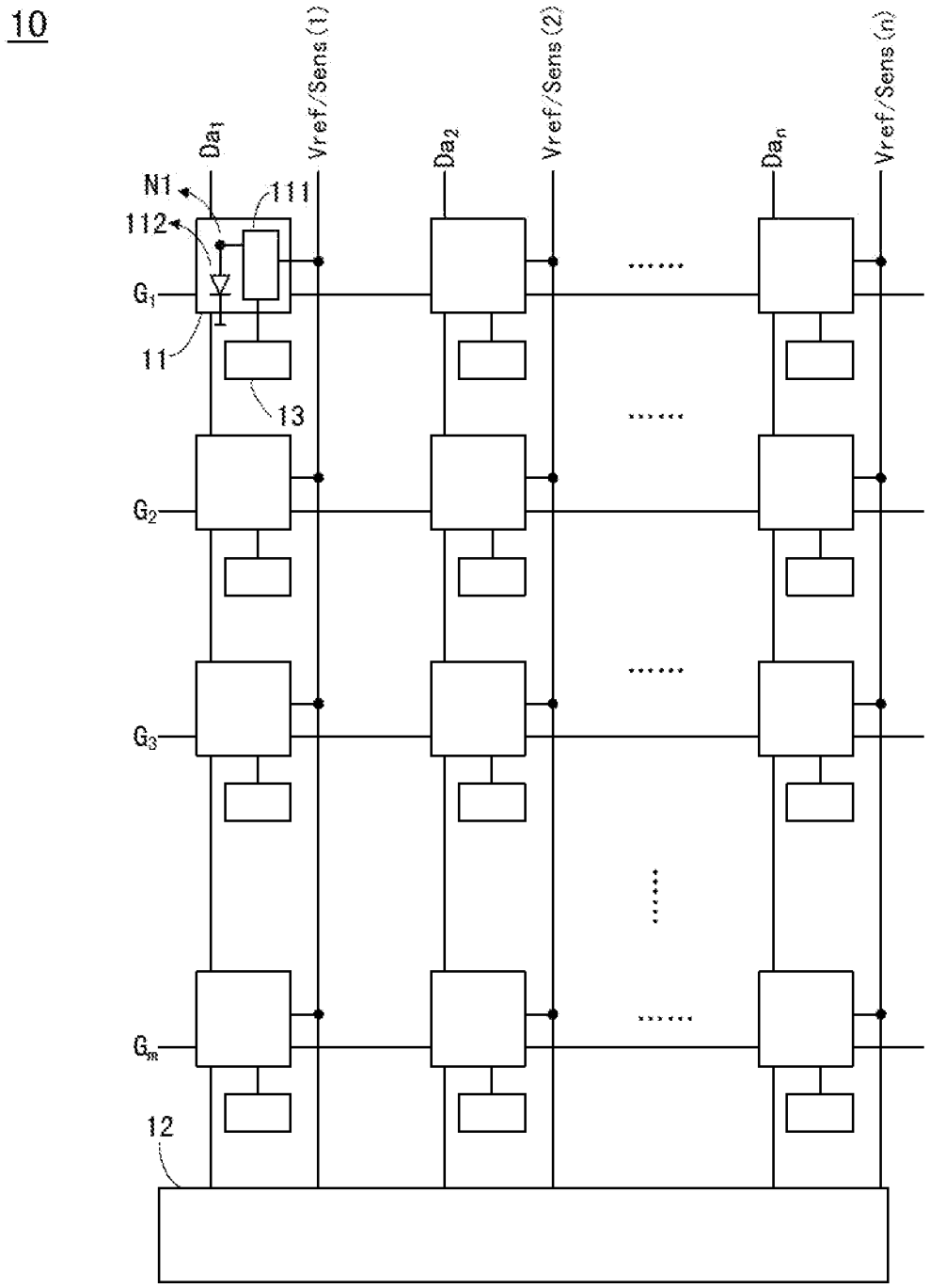
FIG. 1 shows a schematic block diagram of a pixel circuit according to embodiments of the present disclosure.

In order to make objectives, technical solutions, and advantages of the embodiments of the present disclosure clearer, the technical solutions in the embodiments of the present disclosure will be described clearly and completely in conjunction with the accompanying drawings in the embodiments of the present disclosure. Obviously, the described embodiments are a part of the embodiments of the present disclosure, but not all of them. Based on the described embodiments of the present disclosure, all other embodiments obtained by those skilled in the art without creative work are within the protection scope of the present disclosure. It should be noted that throughout the drawings, the same elements are represented by the same or similar reference numerals. In the following description, some specific embodiments are only used for descriptive purposes, and should not be construed as limiting the present disclosure, but are merely examples of the embodiments of the present disclosure. When it may cause confusion in understanding the present disclosure, conventional structures or configurations will be omitted. It should be noted that the shape and size of each component in the drawings do not reflect the actual size and ratio, but merely illustrate contents of the embodiments of the present disclosure.

Unless otherwise defined, technical terms or scientific terms used in the embodiments of the present disclosure should have the usual meanings understood by those skilled in the art. Words such as "first", "second" and similar words used in the embodiments of the present disclosure do not denote any order, quantity or importance, but are only configured to distinguish different components.

In addition, in the description of the embodiments of the present disclosure, a term "electrically connected" may mean that two components are directly electrically connected, or may mean that two components are electrically connected via one or more other components. In addition, these two components may be electrically connected or coupled in a wired or wireless manner.

Transistors used in the embodiments of the present disclosure may all be thin film transistors or field effect transistors or other devices with the same characteristics. According to the role in the circuit, the transistors used in the embodiments of the present disclosure are mainly switching transistors. Since a source and a drain of a thin film transistor used here are symmetrical, the source and the drain may be interchanged. In the embodiments of the present disclosure, one of the source and the drain is called a first electrode, and the other of the source and the drain is called a second electrode. In the following example, a driving transistor is described as an N-type thin film transistor, and other transistors are of the same type as the driving transistor or are of different type from the driving transistor according to the circuit design. Similarly, in other embodiments, the driving transistor may also be shown as a P-type thin film transistor. Those skilled in the art may understand that the technology solutions of the present disclosure may also be realized by correspondingly changing the types of other transistors and inverting each drive signal and level signal (and/or making other additional adaptive modifications).

In addition, in the description of the embodiments of the present disclosure, terms "first level" and "second level" are only configured to distinguish two levels with different amplitudes. In some embodiments, the "first level" may be a high level, and the "second level" may be a low level. Hereinafter, since the driving transistor is exemplified as an N-type thin film transistor, the "first level" is exemplified as a high level, and the "second level" is exemplified as a low level.

In devices that use OLEDs for display, the driving transistor DTFT made by the LIPS process is usually configured to provide a current required for the OLED to emit light. On one hand, as the LTPS process is generally unable to maintain stability, under effects of excimer laser annealing (ELA) crystallization, long-term stress, temperature changes and the like, the threshold voltage Vth and mobility of the transistor may shift. On the other hand, OLED devices may undergo aging after long-term use, which leads to degradation of device characteristics, so that a preset voltage and current cannot be maintained.

The embodiments of the present disclosure will be described in detail below with reference to the drawings.

FIG. 1 shows a schematic block diagram of a pixel circuit 10 according to embodiments of the present disclosure. As shown in FIG. 1, the pixel circuit 10 includes a plurality of pixel units 11, and the plurality of pixel units 11 are arranged in the form of an m×n matrix, wherein m and n are natural numbers. Each pixel unit 11 may include a pixel driving circuit 111 and a light-emitting element 112, wherein the pixel driving circuit 111 is configured to drive the light-emitting element 112 to emit light. As shown in FIG. 1, the pixel driving circuit 111 and the light-emitting element 112 are electrically connected to a first node N1. In the embodiments of the present disclosure, the light-emitting element 112 is exemplified as an OLED element, but this is not to limit the present disclosure. In other embodiments, the light-emitting element 112 may also be other current-driven light-emitting elements.

As shown in FIG. 1, the pixel circuit 10 may further include a first compensation sub-circuit 12. The first compensation sub-circuit 12 is electrically connected to each pixel driving circuit 111 in the plurality of pixel units 11. The first compensation sub-circuit 12 is configured to provide an initialization signal to the pixel driving circuit 111, and obtain a voltage at the first node N1 when the light-emitting element 112 emits light via the pixel driving circuit 111, and generate a compensation data signal based on the voltage at the first node N1.

As shown in FIG. 1, the first compensation sub-circuit 12 includes wirings Vref/Sens(1), Vref/Sens(2) . . . , Vref/Sens (n), that is, there are n wirings in total, corresponding to n columns of pixel units 11 respectively. Each of the wirings Vref/Sens(1), Vref/Sens(2) . . . , Vref/Sens(n) may be used as an input wiring to provide an initialization signal Vref to the pixel driving circuit 111, or may be used as an output wiring to obtain the voltage at the first node N1 when the light-emitting element 112 emits light via the pixel driving circuit 111. The first compensation sub-circuit 12 also includes wirings $Da_1$, $D_{a2}$, . . . , $Da_n$, that is, there are n wirings in total. In the embodiments of the present disclosure, the wirings $Da_1$, $Da_2$, . . . , $Da_n$ may be used as data lines of the pixel circuit 10, which corresponds to n columns of pixel units 11, respectively. In the embodiments of the present disclosure, the pixel driving circuit 111 is provided with a data signal compensated by the first compensation sub-circuit 12. In FIG. 1, wirings $G_1$, $G_2$, $G_3$, . . . $G_m$ are also shown, that is, there are m wirings, $G_1$, $G_2$, $G_3$, . . . , $G_m$, are gate lines of the pixel circuit 10, and they correspond to in rows of pixel units 11, respectively.

According to embodiments of the present disclosure, the pixel driving circuit 111 is fluffier configured to initialize the first node N1 based on the initialization signal Vref, and drive the light-emitting element 112 to emit light by using the compensation data signals $Da_1$, $Da_2$, . . . , $Da_n$.

As shown in FIG. 1, the pixel circuit 10 may further include second compensation sub-circuits 13, and the second compensation sub-circuits 13 are electrically connected to respective pixel driving circuits 111 in the plurality of pixel units 11. The second compensation sub-circuits 13 are configured to keep the voltage at the first node N1 within a set operating voltage range of the light-emitting element 112 at all times.

Figure 2:
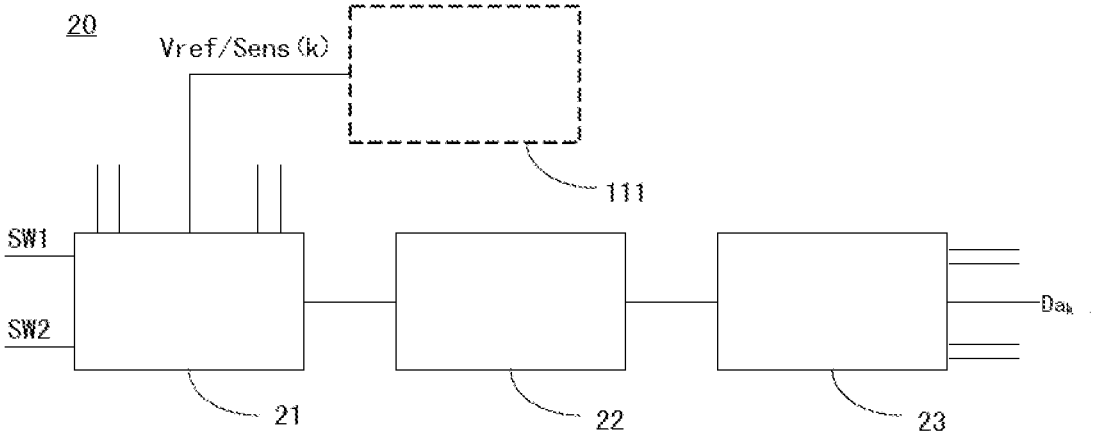
FIG. 2 shows a schematic block diagram of a first compensation sub-circuit according to embodiments of the present disclosure.

FIG. 2 shows a schematic block diagram of the first compensation sub-circuit 20 according to embodiments of the present disclosure. As shown in FIG. 2, the first compensation sub-circuit 20 according to the embodiments of the present disclosure may include a switching sub-circuit 21, a sampling sub-circuit 22 and a data compensation sub-circuit 23.

According to embodiments, the switching sub-circuit 21 is configured to receive a first switching signal SW1 and a second switching signal SW2, and to output the initialization signal at an output terminal of the switching sub-circuit 21 under the control of the first switching signal SW1, and to keep the output terminal of the switching sub-circuit 21 in a floating state under the control of the switching signal SW2.

As shown in FIG. 2, the output terminal Vref/Sens(k) of the switching sub-circuit 21 connected to the $k^{th}$ column of the pixel units is taken as an example for description, wherein k is a natural number and $1 \leq k \leq n$. In FIG. 2, a pixel driving circuit of the $k^{th}$ column of the pixel units is shown in a dashed frame. As shown in FIG. 2, under the control of the first switching signal SW1, the output terminal Vref/Sens(k) outputs a signal Vref. Under the control of the second switching signal SW2, the output terminal Vref/Sens (k) is kept in a floating state, and the voltage at the first node N1 in the $k^{th}$ column of the pixel units connected to the output terminal Vref/Sens(k) may be obtained via the output terminal Vref/Sens(k).

According to embodiments of the present disclosure, the sampling sub-circuit 22 is configured to obtain the voltage at the first node N1 while the output terminal of the switching sub-circuit 21 is kept in a floating state. In some embodiments, the sampling sub-circuit 22 may be an analog-to-digital converter ADC. When the output terminal Vref/Sens (k) of the switching sub-circuit 21 remains in a floating state, the analog-to-digital converter ADC is electrically connected to the output terminal Vref/Sens(k), so that the voltage at the first node N1 is collected by the analog-to-digital converter ADC. In some other embodiments, the sampling sub-circuit 22 may also be a sampling unit formed by a dedicated integrated circuit IC, which are not limited in the embodiments of the present disclosure.

According to embodiments of the present disclosure, the data compensation sub-circuit 23 is configured to generate A compensation data signal $Da_k$ based on a preset compensation model and the voltage at the first node N1. The data compensation sub-circuit 23 has n output terminals, which correspond to the n columns of pixel units 11 respectively, and the compensation data signal $Da_k$ is output through the output terminal electrically connected to the $k^{th}$ column of pixel units. According to the embodiments, a circuit structure for realizing the preset compensation model is built in the data compensation sub-circuit 23, wherein the compensation model may be established according to an aging curve of the OLED, and may compensate the aging of the OLED. In some embodiments, the compensation model may compare the collected voltage at the first node N1 with the expected voltage of the OLED under the brightness, so that the compensation signal is obtained according to the compensation model, and further the voltage is fed back to the data signal to compensate the brightness of the OLED. The present disclosure does not limit the specific implementation of the compensation model. According to the concept of the present disclosure, any solutions which may compensate the OLED brightness based on the voltage feedback of the first node N1 may full within the protection scope of the present disclosure.

Figure 3:
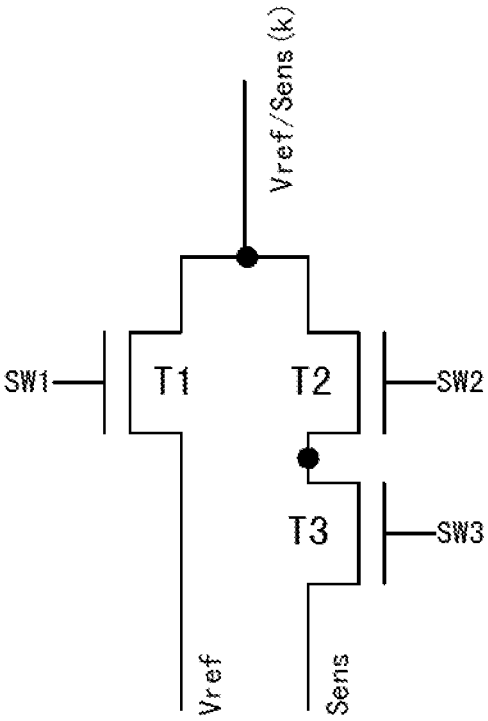
FIG. 3 shows a circuit diagram of a switching sub-circuit according to embodiments of the present disclosure.

According to the embodiments of the present disclosure, by compensating the data signal applied to the pixel driving circuit, the current applied to the OLED is adjusted to stabilize the operating current of the OLED, thereby improving the display effect of the OLED FIG. 3 shows a circuit diagram of the switching sub-circuit 21 according to embodiments of the present disclosure. As shown in FIG. 3, the switching sub-circuit 21 according to the embodiments of the present disclosure includes a first transistor T1, a second transistor T2, and a third transistor 13. In the embodiments, the first transistor T1, the second transistor T2, and the third transistor 13 are all shown as N-type transistors. In other embodiments, a part or all of the first transistor T1, the second transistor T2, and the third transistor T3 may be P-type transistors.

As shown in FIG. 3, a gate of the first transistor T1 is electrically connected to receive the first switching signal SW1, a first electrode of the first transistor T1 is electrically connected to receive the initialization signal Vref, and a second electrode of the first transistor T1 is electrically connected to a second electrode of the transistor T2 and serves as the output terminal Vref/Sens(k) of the switching sub-circuit 21. A gate of the second transistor 12 is electrically connected to receive the second switching signal SW2, and a first electrode of the second transistor T2 is electrically connected to a first electrode of the third transistor 13. A gate of the third transistor T3 is electrically connected to receive a sampling control signal SW3, and a second electrode of the third transistor T3 is a terminal Sens for sensing and is electrically connected to the sampling sub-circuit 22.

As shown in FIG. 3, when the first switching signal SW1 is at a first level (for example, a high level), and the second switching signal SW2 and the sampling control signal SW3 are at a second level (for example, a low level), the transistor T1 is turned on, and the transistors 12 and T3 are turned off. At this time, the initialization signal ref applied to the first electrode of the transistor T1 is output to the output terminal Vref/Sens(k) via the transistor T1, so that the initialization signal may be provided to the corresponding pixel driving circuit 111. When the second switching signal SW2 is at the first level (for example, the high level) and the first switching signal SW1 and the sampling control signal SW3 are at the second level (for example, the low level), the transistor T2 is turned on, and the transistors T1 and 13 are turned off. At this time, the output terminal Vref/Sens(k) may be placed in a floating state. The voltage at the first node N1 may continuously charge a lead of the output terminal Vref/Sens (k), so that the voltage at the first node N1 may be obtained at the output terminal Vref/Sens(k). Next, the sampling control signal SW3 is set to the first level (for example, the high level), that is, the sampling sub-circuit 22 is communicated with the output terminal Vref/Sens(k), so that the voltage at the first node N1 may be sampled by the sampling sub-circuit 22.

Figure 4:
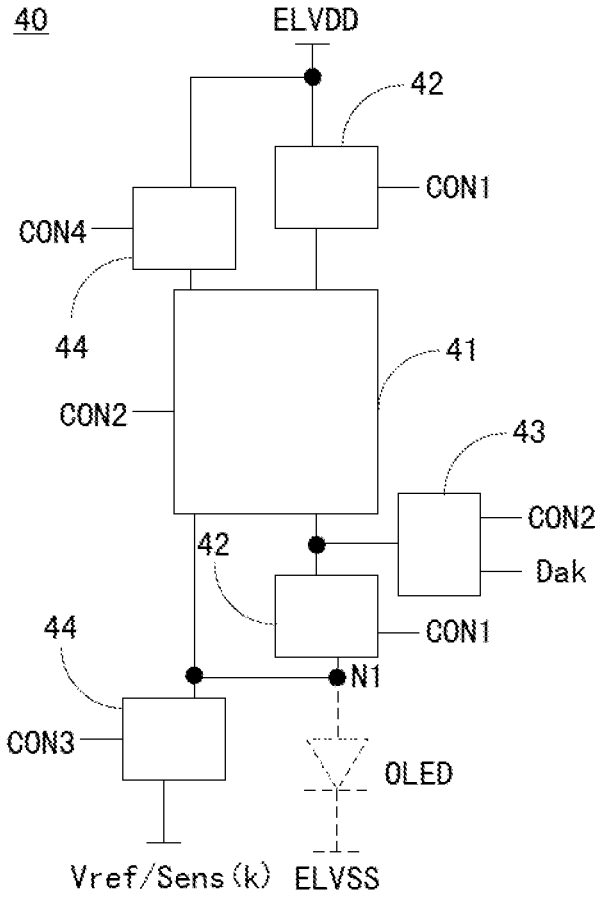
FIG. 4 shows a schematic block diagram of a pixel driving circuit according to embodiments of the present disclosure.

FIG. 4 shows a schematic block diagram of a pixel driving circuit according to embodiments of the present disclosure. In order to more clearly show the connection relationship between the pixel driving circuit and the light-emitting element OLED, the light-emitting element OLED is shown in the form of a dotted line. As shown in FIG. 4, a first end of the light-emitting element OLED and the pixel driving circuit 40 are electrically connected to the first node N1, and a second end of the light-emitting element OLED is electrically connected to a fixed voltage ELVSS. As shown in FIG. 4, the first end may be an anode of the light-emitting element OLED, and the second end may be a cathode of the light-emitting element OLED.

As shown in FIG. 4, the pixel driving circuit 40 includes a driving sub-circuit 41, and the driving sub-circuit 41 and the light-emitting element OLED are electrically connected to the first node N1 to generate a current for causing the light-emitting element OLED to emit light.

As shown in FIG. 4, the pixel driving circuit 40 also includes a light emission control sub-circuit 42. A first part of the light emission control sub-circuit 42 is electrically connected to a fixed voltage signal ELVDD (a first voltage signal) and the driving sub-circuit 41. A second part of the light emission control sub-circuit 42 is electrically connected to the driving sub-circuit 41 and the light-emitting element OLED. As shown in FIG. 4, the light emission control sub-circuit 42 is configured to receive a first control signal CON1, and to provide the current for causing the light-emitting element OLED to emit light to the light-emitting element OLED under the control of the first control signal CON1.

As shown in FIG. 4, the pixel driving circuit 40 further includes a driving control sub-circuit 43, the driving control sub-circuit 43 is electrically connected to a node between the driving sub-circuit 41 and the second part of the light emission control sub-circuit 42. The driving control sub-circuit 43 is configured to receive the compensation data signal $Da_k$ and a second control signal CON2, and to provide the compensation data signal $Da_k$ to the driving sub-circuit 41 under the control of the second control signal CON2. According to the foregoing embodiments, the compensation data signal $Da_k$ is a signal provided by the first compensation sub-circuit 12.

As shown in FIG. 4, the pixel driving circuit 40 further includes a reset sub-circuit 11. A first part of the reset sub-circuit 44 is electrically connected between the driving sub-circuit 41 and the first compensation sub-circuit 12. As shown in FIG. 4, the first part of the reset sub-circuit 11 and the driving sub-circuit are electrically connected to the first node N1 between the driving sub-circuit 44 and the light-emitting element OLED, and are electrically connected to the output terminal Vref/Sens(k) of the switching sub-circuit 21 in the first compensation sub-circuit 12. The part of the reset sub-circuit 44 is configured to receive a fourth control signal CON4, and to apply the initialization signal Vref provided by the first compensation sub-circuit 12 to the first node N1 under the control of the fourth control signal or to output the voltage at the first node N1 when the OLED emits light (that is, the voltage of the anode of the light-emitting element OLED) to the first compensation sub-circuit 12 under the control of the fourth control signal. A second part of the reset sub-circuit 44 is electrically connected between the first voltage signal ELVDD and the driving sub-circuit 41, and receives the fourth control signal CON4. The part of the reset sub-circuit 44 is configured to reset the driving sub-circuit 41 under the control of the fourth control signal.

Figure 5:
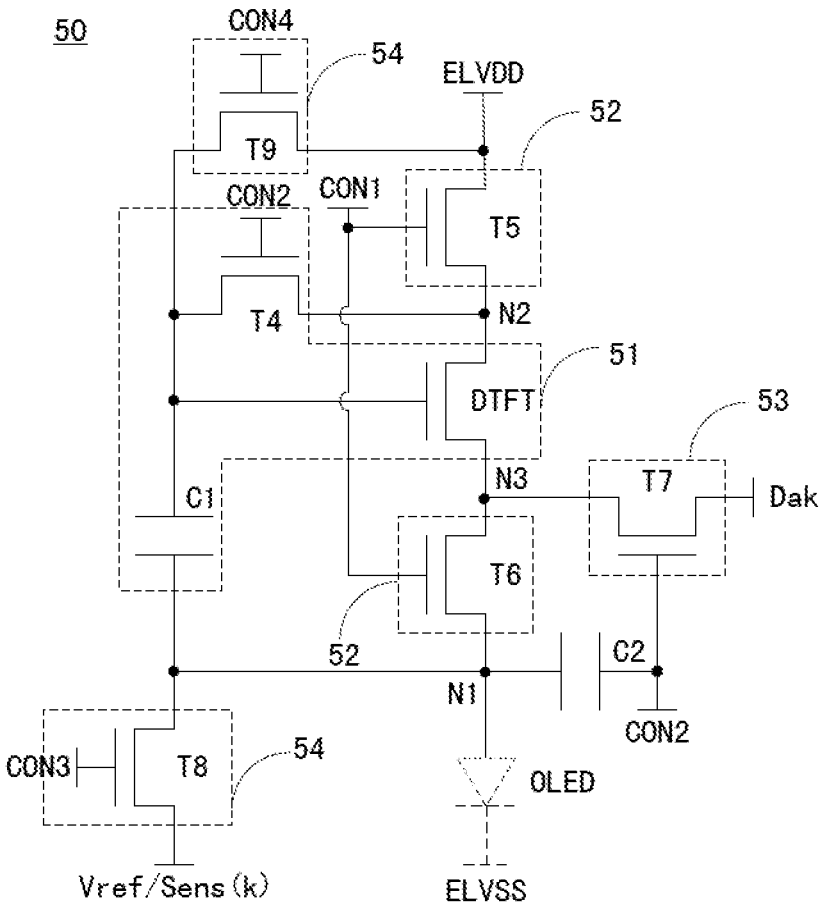
FIGS. 5 and 6 show circuit diagrams of pixel driving circuits according to embodiments of the present disclosure.
Figure 6:
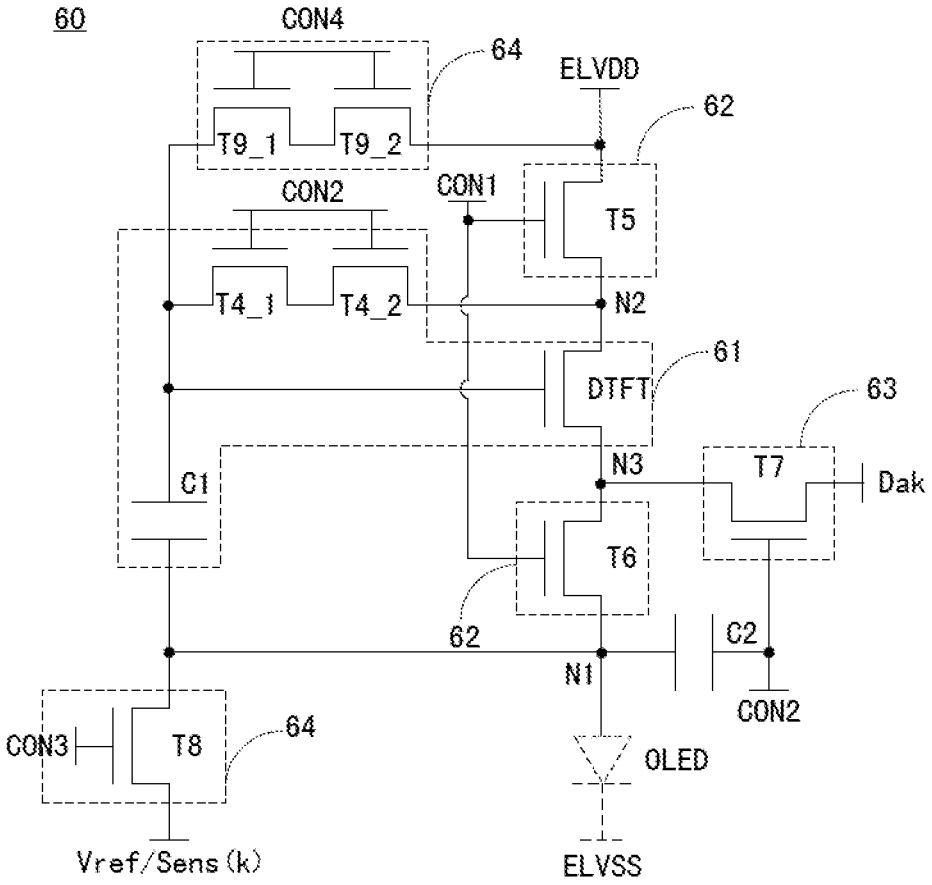

FIGS. 5 and 6 respectively show circuit diagrams of the pixel driving circuit 50 and the pixel driving circuit 60 according to embodiments of the present disclosure. Next, two examples according to the embodiments of the present disclosure will be described in detail with reference to FIGS. 5 and 6.

As shown in FIG. 5, the driving sub-circuit 41 of the pixel driving circuit 50 includes a driving transistor DTFT, a fourth transistor T4 and a storage capacitor C. A gate of the driving transistor D1 is electrically connected to a first end of the storage capacitor C1, a drain of the driving transistor DTFT and a first part of the light emission control sub-circuit 52 are electrically connected to a second node N2, a source of the driving transistor DTFT and a second part of the light emission control sub-circuit 52 is electrically connected to a third node N3. A gate of the fourth transistor T4 is electrically connected to receive the second control signal CON2, a first electrode of the fourth transistor T4 is electrically connected to the first end of the storage capacitor C1, and a second electrode of the fourth transistor T4 is electrically connected to the second node N2. The first end of the storage capacitor C1 is electrically connected to the gate of the driving transistor DTFT and the first electrode of the fourth transistor 14, and the second end of C1 is electrically connected to the first node N1.

As shown in FIG. 5, the light emission control sub-circuit 52 of the pixel driving circuit 50 includes a fifth transistor T5 and a sixth transistor 16. A gate of the fifth transistor T5 is electrically connected to receive the first control signal CON1, a first electrode of the fifth transistor T5 is electrically connected to receive the first voltage signal ELVDD and a second electrode of the fifth transistor T5 is electrically connected to the second node N2. A gate of the sixth transistor 16 is electrically connected to receive the first control signal CON1, a first electrode of the sixth transistor T6 is electrically connected to the third node N3, and a second electrode of the sixth transistor T6 is electrically connected to the first node N1.

As shown in FIG. 5, the driving control sub-circuit 53 of the pixel driving circuit 50 includes a seventh transistor T7. A gate of the seventh transistor T7 is electrically connected to receive the second control signal CON2, and a first electrode of the seventh transistor 17 is electrically connected to receive the compensation data signal $Da_k$, and a second electrode of the seventh transistor 17 is electrically connected to the third node N3.

As shown in FIG. 5, the reset sub-circuit 54 of the pixel driving circuit 50 includes an eighth transistor T8 and a ninth transistor T9. A gate of the eighth transistor T8 is electrically connected to receive the third control signal CON3, a first electrode of the eighth transistor T8 is electrically connected to the first node N1, and a second electrode of the eighth transistor T8 is electrically connected to the first compensation sub-circuit 12, namely the output terminal Vref/Sens (k) of the switching sub-circuit 21. A gate of the ninth transistor T9 is electrically connected to receive the fourth control signal CON4, a first electrode of the ninth transistor T9 is electrically connected to receive the first voltage signal ELVDD and a second electrode of the ninth transistor 19 is electrically connected to the first end of the storage capacitor C1.

By Using the pixel circuit of the embodiments of the present disclosure, a change in the threshold voltage Vth caused by factors such as temperature drift within the driving transistor may be compensated to ensure that the DTFT outputs a stable current under different working conditions. Also, changes in OLED characteristics caused by the aging of the light-emitting element OLED may be compensated to ensure the display effect of the OLED device when the OLED device is aging. The embodiments of the present disclosure may ensure the characteristics of the OLED device after long-term use, thereby prolonging the service life and improving image quality of the OLED display.

Each transistor in the pixel driving circuit 50 has a parasitic capacitance. These parasitic capacitances will affect the first node N1, that is, affect the voltage of the anode of the light-emitting element OLED, thereby affecting the displayed image. Therefore, in the pixel circuit 10 according to the embodiments of the present disclosure, a second compensation sub-circuit 13 is provided.

As shown in FIG. 5, the second compensation sub-circuit 13 according to the embodiments of the present disclosure includes a plurality of compensation capacitors C2, a first end of each compensation capacitor C2 is electrically connected to the first node N1, and a second end of each compensation capacitor C2 is electrically connected to the gate of the seventh transistor T7. The second compensation sub-circuit 13 may reduce light leakage of the OLED device in black state. That is, when the second control signal CON2 is at the low level, the compensation capacitor C2 is coupled to the anode of the light-emitting element OLED to reduce the voltage of the anode of the light-emitting element OLED during the light-emitting period, so as to prevent light leakage of the OLED device in the black state which otherwise affects the contrast.

The pixel driving circuit 60 shown in FIG. 6 has substantially the same structure as the pixel driving circuit 50 shown in FIG. 5. The difference is in that the fourth transistor and the ninth transistor both adopt dual-gate transistors. As shown in FIG. 6, the fourth transistor is denoted as T4_1 and T4_2, and the ninth transistor is denoted as T9_1 and T9_2. The dual-gate structure of the transistor may better reduce the leakage current of the transistor, thereby helping to improve the display effect.

In addition, different types of transistors may also be used to implement the embodiments of the present disclosure according to specific implementation requirements and implementation processes. For example, in some embodiments, P-type or N-type LTPS, LTPO, or IGZO transistors may be included in the circuit structure. Those skilled in the art can easily understand these modified circuit structures, which will not be repeated here.

Figure 7:
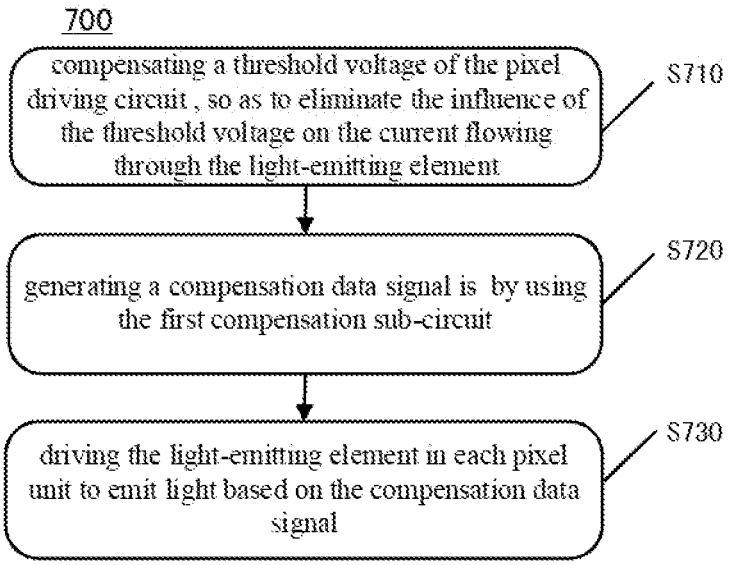
FIG. 7 shows a flowchart of a driving method of a pixel circuit according to embodiments of the present disclosure.

According to embodiments of the present disclosure, a driving method for driving a pixel circuit is also provided. FIG. 7 shows a flowchart of a driving method 700 of a pixel circuit according to embodiments of the present disclosure. As shown in FIG. 7, the driving method 700 may include the following steps.

In step S710, a threshold voltage of the pixel driving circuit is compensated, so as to eliminate an influence of the threshold voltage on current flowing through the light-emitting element.

In step S720, a compensation data signal is generated by using the first compensation sub-circuit.

In step S730, the light-emitting element in each pixel unit is driven to emit light based on the compensation data signal.

In some embodiments, before driving the light-emitting element in each pixel unit to emit light, the compensation data signal may be generated based on the light-emitting brightness of the selected light-emitting element. In this case, it is only necessary to select a compensation model through one compensation before starting the image display, and it is assumed that each of the light-emitting elements in the pixel units is suitable for the selected compensation model. According to the embodiments, the light-emitting brightness of the selected light-emitting element may be a black-state image, and original data signals corresponding, to the selected light-emitting brightness are gray scales in the black state display. The compensation data signal is obtained according to the original data signals, and the compensation model is selected. In other embodiments, the light-emitting brightness of the selected light-emitting element may be a fixed white-state brightness, or may also be a certain selected brightness higher than the white-state brightness during normal display. By generating the compensation data signal based on the light-emitting brightness of the selected light-emitting element only before driving the light-emitting element in each pixel unit to emit light, the aging of the OLED may be compensated to a certain extent, thereby improving the display effect with considering the display efficiency.

In some embodiments, in the process of driving the light-emitting element in each pixel unit to emit light, the compensation data signal may be generated based on the light-emitting brightness of the light-emitting element in each pixel unit. In this case, it is necessary to perform compensation for each light-emitting element during the light-emitting process of each of light-emitting elements in the pixel units. This compensation method may more accurately compensate the aging characteristics of each light-emitting element, and may provide better display quality.

It is easy to understand that, in some embodiments, the compensation data signal may be generated based on the light-emitting brightness of light-emitting element in each of selected pixel units during the light-emitting process of each light-emitting element in the pixel unit. In a specific embodiment, the light-emitting brightness of the selected light-emitting elements may include a black-state image, a fixed white-state brightness, or a certain selected brightness higher than the white-state brightness during normal display. In this case, it is not necessary to feedback actual brightness of the light-emitting element in each pixel unit in real time, and only need to perform a calculation based on the compensation model determined by the brightness of the selected light-emitting elements, and at the same time the compensation model is selected for the light-emitting element in each pixel unit, and the improvement of the display effect and the influence on the display efficiency are between the above two embodiments.

Figure 8:
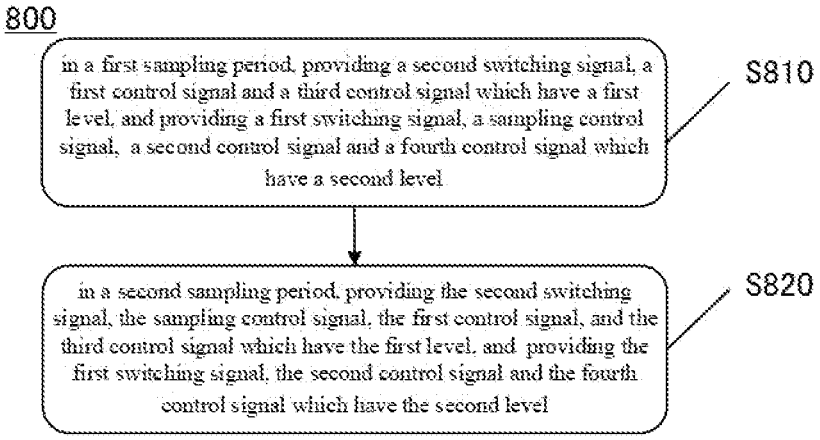
FIG. 8 shows an operation flowchart of a driving method of a pixel circuit according to embodiments of the present disclosure in a sampling period.
Figure 9:
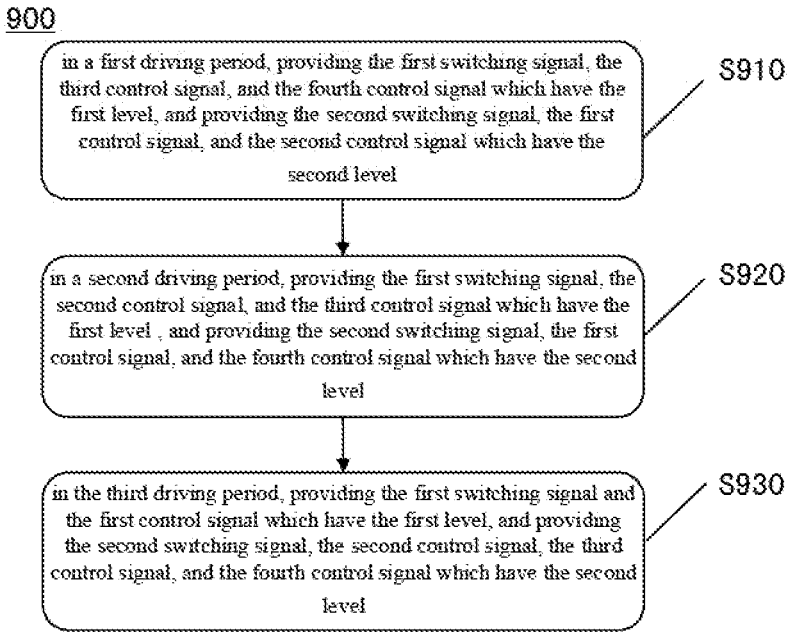
FIG. 9 shows an operation flowchart of a driving method of a pixel circuit according to embodiments of the present disclosure in a driving period.

FIG. 8 shows a flowchart of operations 800, in a sampling period, of the driving method of a pixel circuit according to embodiments of the present disclosure, and FIG. 9 shows a flowchart of operations 900, in a driving period, of the driving method of a pixel circuit according to embodiments of the present disclosure.

As shown in FIG. 8, the operations 800 in which the first compensation sub-circuit is used to generate the compensation data signal in the sampling period may include the following steps.

In step S810, in a first sampling period, a second switching signal, a first control signal and a third control signal which all have a first level are provided, and a first switching signal, a sampling control signal, a second control signal and a fourth control signal which all have a second level are provided.

In step S820, in a second sampling period, the second switching signal, the sampling control signal, the first control signal, and the third control signal which all have the first level are provided, and the first switching signal, the second control signal and the fourth control signal which all have the second level are provided.

As shown in FIG. 9, the operations 900 in which the light-emitting element in each pixel unit is driven to emit light based on the compensation data signal in the driving period may include the following steps.

In step S910, in a first driving period, the first switching signal, the third control signal, and the fourth control signal which all have the first level are provided, and the second switching signal, the first control signal, and the second control signal which all have the second level are provided.

In step S920, in a second driving period, the first switching signal, the second control signal, and the third control signal which all have the first level are provided, and the second switching signal, the first control signal, and the fourth control signal which all have the second level are provided.

In step S930, in the third driving period, the first switching signal and the first control signal which both have the first level are provided, and the second switching signal, the second control signal, the third control signal, and the fourth control signal which all have the second level are provided.

Figure 10:
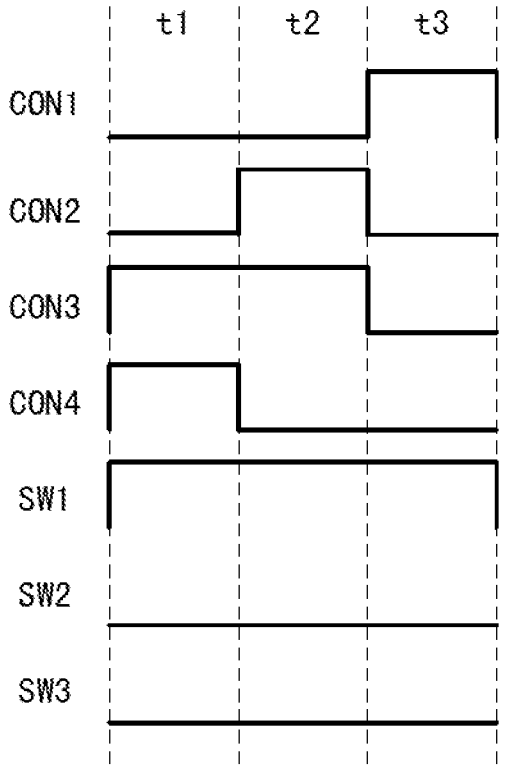
FIGS. 10 and 11 show timing diagrams of a driving method of a pixel circuit according to embodiments of the present disclosure.
Figure 11:
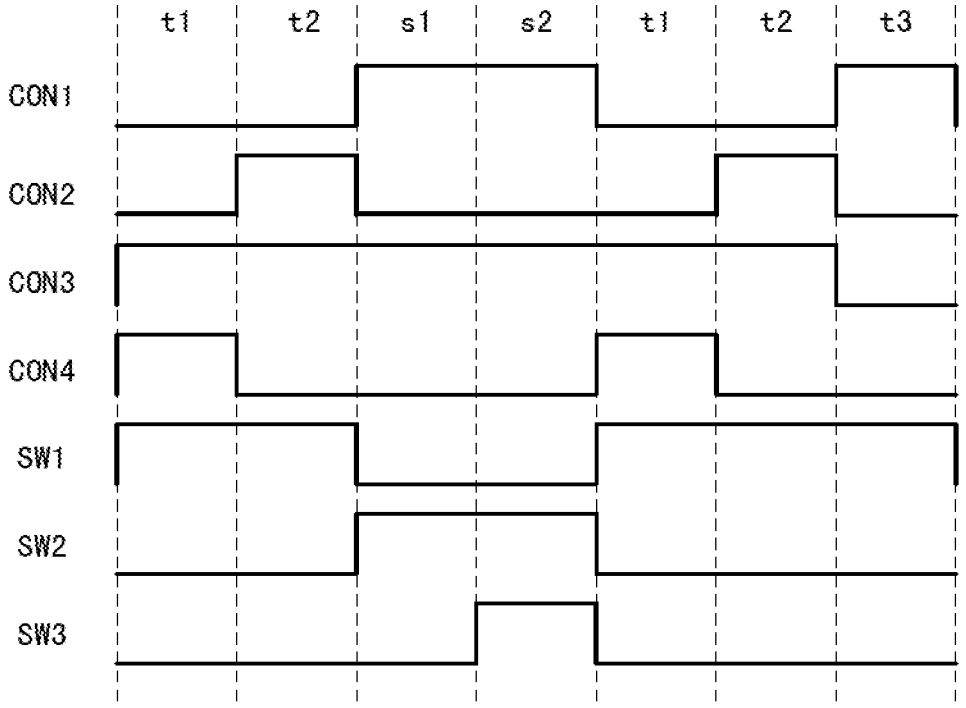

FIGS. 10 and 11 show timing diagrams of a driving method of a pixel circuit according to embodiments of the present disclosure. The driving method of the pixel circuit will be described below with reference to FIGS. 1, 2, 3, 5, 10, and 11 in conjunction with specific embodiments.

As shown in FIG. 10, it shows operation timing of the pixel driving circuit when the pixel circuit is not switched to the compensation mode, that is, when the data signal is not compensated.

In the first driving period (t1 period), the first control signal CON1 is at a low level, so that the transistors T5 and T6 are turned off. The second control signal CON2 is at a low level, so that the transistors T4 and T7 are turned off. The first switching signal SW1 is at a high level, and the second switching signal SW2 is at a low level, so that the output terminal Vref/Sens(k) of the switching sub-circuit 21 outputs the initialization voltage Vref. The third control signal CON3 and the fourth control signal CON4 are at a high level. Since the third control signal CON3 is at a high level, the transistor T8 is turned on, and the second end of the storage capacitor C1 and the anode of the light-emitting element OLED are initialized, that is, the voltage at the first node N1 is initialized to Vref, namely, VAnode=Vref. Since the fourth control signal CON4 is at a high level, the transistor T9 is turned on, and the first end of the storage capacitor C1 and the gate of the driving transistor DTFT are initialized, that is, the first end of the storage capacitor C1 and the gate of the dining transistor DTFT are initialized to the first voltage ELVDD, namely, VDTFT_G=ELVDD.

In the second driving; period t2 period), the first control signal CON1 is at a low level, so that the transistors T5 and 16 are kept off. The fourth control signal CON4 is at a low level, so that the transistor T9 is turned off. The first switching signal SW1 is at a high level, and the second switching signal SW2 is at a low level, therefore the output terminal Vref/Sens(k) of the switching sub-circuit 21 maintains the initializing voltage Vref. The second control signal CON2 is at a high level, so that the transistors T4 and T7 are turned on. Since the transistor 14 is turned on, the drain and the gate of the driving transistor DTFT are electrically connected, and the DTFT forms a diode structure. Charges at the gate of the DTFT (that is, the first end of the storage capacitor) flow to the data signal line through the transistors T4, DTFT and T7. When it reaches VDTFT_G=Vdata+Vth, wherein Vth (Vth>0) is the threshold voltage of the driving transistor DTFT, and Vdata represents the uncompensated data signal, that is, in FIG. 4, what is actually received at the position where $Da_k$ is received is the uncompensated data signal Vdata. In this period, the third control signal CON3 is always maintained at a high level, so that the transistor T3 is maintained to be turned on, thus the anode of the switching element OLED is always maintained at the Vref potential.

In the third driving period (t3 period), the second control signal CON2, the third control signal CON3, and the fourth control signal CON4 are at a low level, therefore the transistors 14, T7, T8, and T9 are turned off. The first control signal CON1 is at a high level, so the transistors T5 and T6 are turned on, and current flows through the light-emitting element OLED so that the OLED emits light. In addition, the first switching signal SW1 is at a high level, and the second switching signal SW2 is at a low level, so that the output terminal Vref/Sens(k) of the switching sub-circuit 21 maintains the output initialization voltage Vref. Since Vgs=VDTFT_G-VAnode=Vdata+Vth-Vref, wherein Vgs denotes a voltage applied between the gate and the source of the driving transistor DTFT, the current Id flowing through the OLED may be calculated as:

$$Id = \frac{1}{2} * \mu * C_{ox} * \frac{W}{L} * (V_{gs} - V_{th})^2 = \frac{k}{2} * (V_{data} - V_{ref})^2$$

wherein, k is a constant related to the OLED process and characteristics. Therefore, the threshold voltage Vth of the driving transistor DTFT is not included in the current Id, and the compensation for Vth is realized.

As shown in FIG. 11, it shows operation timing for driving the light-emitting element to emit light with the compensated data signal when the pixel circuit is switched to the compensation mode. In the following example, the operation of generating the compensation data signal based on the light-emitting brightness of the light-emitting element in each pixel unit in the process of driving the light-emitting element in each pixel nit to emit light is explained.

In the first driving period (t1 period), the first control signal CON1 is at a low level, so that the transistors 15 and 16 are turned off. The second control signal CON2 is at a low level, so that the transistors 14 and 17 are turned off. The first switching signal SW1 is at a high level, and the second switching signal SW2 is at a low level, so that the output terminal Vref/Sens(k) of the switching sub-circuit 21 outputs the initialization voltage Vref. The third control signal CON3 and the fourth control signal CON4 are at a high level. Since the third control signal CON3 is at a high level, the transistor T8 is turned, and the second end of the storage capacitor C1 and the anode of the light-emitting element OLED are initialized, that is, the voltage at the first node N1 is initialized to Vref, namely. VAnode=Vref. Since the fourth control signal CON4 is at a high level, the transistor T9 is turned on, and the first end of the storage capacitor C1 and the gate of the driving transistor DTFT are initialized, that is, the first end of the storage capacitor C1 and the gate of the driving transistor DTFT are initialized to the first voltage ELVDD, namely, VDTFT_G=ELVDD.

In the second driving period (t2 period), the first control signal CON1 is at a low level, so that the transistors T5 and 16 are kept off. The fourth control signal CON4 is at a low level, so that the transistor T9 is turned off. The first switching signal, SW1 is at a high level, and the second switching signal SW2 is at a low level, so that the output terminal Vref/Sens(k) of the switching sub-circuit 21 maintains the output of the initialization voltage Vref. The second control signal CON2 is at a high level, so that the transistors T4 and T7 are turned on. Since the transistor 14 is turned on, the drain and the gate of the driving transistor DTFT are electrically connected, and the DTFT forms a diode structure. The charges at the gate of the DTFT (that is, the first end of the storage capacitor) flow to the data signal line through the transistors T4, DTFT and T7. When it reaches VDTFT_G=Vdata+Vth, wherein Vth (Vth>0) is the threshold voltage of the driving transistor DTFT, and Vdata represents the uncompensated initial data signal, which is a theoretical data signal without considering the aging of the OLED device. In this period, the third control signal CON3 is always maintained at a high level, so that the transistor T3 is maintained to be turned on, so that that the anode of the switching element OLED is always maintained at the Vref potential.

In the first sampling period (s1 period), the second control signal CON2 and the fourth control signal CON4 are at low level, so that the transistors T4, T7, and T9 are turned off. The first switching signal SW1 and the sampling control signal SW3 are at a low level, and the second switching signal SW2 is at a high level, therefore the output terminal Vref/Sens(k) of the switching sub-circuit 21 is kept in a floating state. The third control signal CON3 is at a high level, so that the transistor 18 is turned on. Since the output terminal Vref/Sens(k) is kept in a floating state, the voltage at the first node N1 may be obtained at the output terminal Vref/Sens(k), that is voltage of the anode of the light-emitting element OLED. The first control signal CON1 is at a high level, so that the transistors T5 and T6 are turned on, and the initial data signal Vdata written in the t2 period is configured to drive the light-emitting element OLED to emit light. At the same time, the anode of the light-emitting element OLED continuously charges Vref/Sens(k) through T8 until it reaches the voltage stabilization stage, at this time the OLED reaches the normal display brightness, and the actual voltage at the OLED anode is obtained at Vref/Sens (k).

In the second sampling period (s2 period), the first control signal CON1, the second control signal CON2, the third control signal CON3, the fourth control signal CON4, the first switching signal SW1, and the second switching signal SW2 are maintained at the same level as the s1 period. The sampling control signal SW3 is at a high level, and the sampling sub-circuit 22 is connected to the output terminal Vref/Sens(k) to sample the voltage at the first node N1. In some embodiments, when the sampling sub-circuit 22 is an analog-to-digital converter ADC, the output terminal Vref/Sens(k) is communicated with the input terminal of the ADC device, and the ADC device reads the voltage at the first node N1, namely, the voltage of the OLED anode. Next, the data compensation sub-circuit 23 may compare the collected voltage at the first node N1 with the expected voltage of the OLED under the brightness, and the compensation signal is obtained according to the compensation model in the data compensation sub-circuit 23, and further it is fed back to the data signal through gamma voltage, thereby generating a compensation data signal $Da_k$, and applying the compensation data signal $Da_k$ to the first electrode of the transistor T7.

Then, the operations of the first driving period (t1 period), the second driving period (t2 period), and the third driving period (t3 period) are sequentially performed again, and the light-emitting element OLED is driven to emit light with the compensation data signal $Da_k$, thereby realizing the compensation for the aging of OLED. Regarding the operations of the first driving period (t1 period), the second driving period (t2 period), and the third driving period (t3 period), reference may be made to the foregoing description, which will not be repeated here.

For the case where the compensation data signal is generated based on the light-emitting brightness of the selected light-emitting element before driving the light-emitting element in each pixel unit to emit light, only before the light-emitting element normally displays, the first driving period (t1 period), the second driving period (t2 period), the first sampling period (s1 period), and the second sampling period (s2 period) mentioned above may be repeated once based on the light-emitting brightness of the selected light-emitting element, so as to select a unified compensation model to compensate all light-emitting elements.

By using the driving method of the embodiments of the present disclosure, a change in the threshold voltage Vth caused by factors such as temperature drift within the driving transistor may be compensated to ensure that the DTFT outputs a stable current under different working conditions. Also, changes in OLED characteristics caused by the aging of the light-emitting element OLED may be compensated to ensure the display effect of the OLED device when the OLED device is aging. The embodiments of the present disclosure may ensure the characteristics of the OLED device after long-term use, thereby prolonging the service life and improving image quality of the OLED display.

Figure 12:
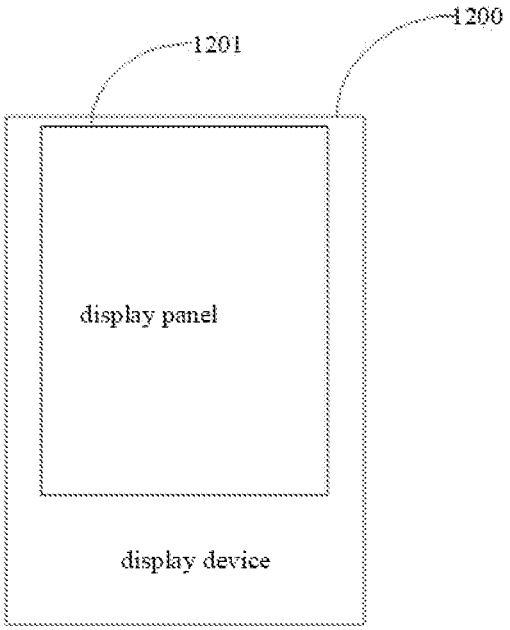
FIG. 12 shows a schematic block diagram of a display device according to embodiments of the present disclosure.

The embodiments of the present disclosure also provide a display panel and a driving method of the display panel. FIG. 12 shows a schematic block diagram of a display device according to embodiments of the present disclosure, and FIG. 13 shows a flowchart of a display method of a display device according to embodiments of the present disclosure.

As shown in FIG. 12, a display device 1200 according to embodiments of the present disclosure may include a display panel 1201, and the display panel 1201 includes a pixel circuit 10 according to embodiments of the present disclosure. The display device 900 may be any product or component with a display function such as electronic paper, mobile phone, tablet computer, television, display, notebook computer, digital photo frame, navigator, etc.

Figure 13:
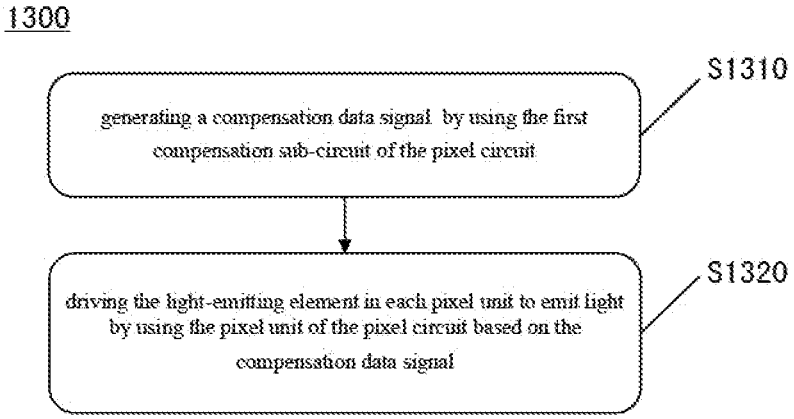
FIG. 13 shows a flowchart of a display method of a display device according to embodiments of the present disclosure.

As shown in FIG. 13, the method of using the display device 1200 for display may include the following steps.

In step S1310, a compensation data signal is generated by using the first compensation sub-circuit of the pixel circuit.

In step S1320, the light-emitting element in each pixel unit is driven to emit light by using the pixel unit of the pixel circuit based on the compensation data signal.

In some embodiments, before driving the light-emitting element in each pixel unit to emit light, the first compensation sub-circuit may be used to generate the compensation data signal based on the light-emitting brightness of the selected light-emitting element.

In some embodiments, in the process of driving the light-emitting element in each pixel unit to emit light, the first compensation sub circuit may be used to generate the compensation data signal based on the light-emitting brightness of the light-emitting element in each pixel unit.

The above detailed description has explained various embodiments by using schematic diagrams, flowcharts, and/or examples. In the case where such schematic diagrams, flowcharts and/or examples contain one or more functions and/or operations, those skilled in the art should understand that each function and/or operation in such schematic diagrams, flowcharts or examples may be implemented individually and/or together through various structures, hardware, software, firmware or substantially any combination thereof.

Although the present disclosure has been described with reference to a few typical embodiments, it should be understood that the terms used are illustrative and exemplary rather than restrictive. Since the present disclosure may be implemented in various forms without departing from the spirit or essence of the disclosure, it should be understood that the above-mentioned embodiments are not limited to any of the foregoing details, but should be interpreted broadly within the spirit and scope defined by the appended claims. Therefore, all changes and modifications falling within the scope of the claims or their equivalents shall be covered by the appended claims.

What is claimed is:

1. A pixel circuit, comprising:

a plurality of pixel units arranged in a matrix, wherein each pixel unit comprises a light-emitting element and a pixel driving circuit for driving the light-emitting element to emit light, and the pixel driving circuit and the light-emitting element are electrically connected to a first node;

a first compensation sub-circuit electrically connected to each pixel driving circuit in each of the plurality of pixel units, wherein the first compensation sub-circuit is configured to provide an initialization signal to the pixel driving circuit, and to obtain a voltage at the first node when the light-emitting element emits light via the pixel driving circuit, and to generate a compensation data signal based on the voltage at the first node; and a second compensation sub-circuit electrically connected to each pixel driving circuit in each of the plurality of pixel units and configured to keep the voltage at the first node within a set operating voltage range of the light-emitting element, wherein the pixel driving circuit is further configured to initialize the first node based on the initialization signal, and to use the compensation data signal to drive the light-emitting element to emit light, wherein the first compensation sub-circuit comprises:

a switching sub-circuit configured to receive a first switching signal and a second switching signal, and to output the initialization signal at an output terminal of the switching sub-circuit under the control of the first switching signal and keep the output terminal in a floating state under the control of the second switching signal;

a sampling sub-circuit configured to obtain the voltage at the first node while the output terminal is kept in the floating state; and a data compensation sub-circuit configured to generate the compensation data signal based on a preset compensation model and the voltage at the first node.

2. The pixel circuit according to claim 1, wherein the switching sub-circuit comprises a first transistor, a second transistor, and a third transistor, wherein a gate of the first transistor is electrically connected to receive the first switching signal, a first electrode of the first transistor is electrically connected to receive the initialization signal, and a second electrode of the first transistor is electrically connected to a second electrode of the second transistor and serve as the output terminal;

a gate of the second transistor is electrically connected to receive the second switching signal, and a first electrode of the second transistor is electrically connected to a first electrode of the third transistor;

a gate of the third transistor is electrically connected to receive a sampling control signal, and a second electrode of the third transistor is electrically connected to the sampling sub-circuit.

3. The pixel circuit according to claim 1, wherein the pixel driving circuit comprises:

a driving sub-circuit configured to generate a current for causing the light-emitting element to emit light;

a light emission control sub-circuit electrically connected to the light-emitting element and the driving sub-circuit, and configured to receive a first control signal and supply a current for causing the light-emitting element to emit light to the light-emitting element under the control of the first control signal;

a driving control sub-circuit electrically connected to the driving sub-circuit, and configured to receive the compensation data signal and a second control signal, and to provide the compensation data signal to the driving sub-circuit under the control of the second control signal; and a reset sub-circuit electrically connected to the driving sub-circuit and the first compensation sub-circuit, and configured to receive a third control signal and a fourth control signal, and to apply the initialization signal provided by the first compensation sub-circuit to the first node under the control of the third control signal and the fourth control signal or to output the voltage at the first node when the light-emitting element emits light to the first compensation sub-circuit under the control of the third control signal and the fourth control signal.

4. The pixel circuit according to claim 1, wherein the driving sub-circuit comprises a driving transistor, a fourth transistor and a storage capacitor, wherein a gate of the driving transistor is electrically connected to a first end of the storage capacitor, a drain of the driving transistor and the light emission control sub-circuit are electrically connected to a second node, and a source of the driving transistor and the light emission control sub-circuit are electrically connected to a third node;

a gate of the fourth transistor is electrically connected to receive the second control signal, a first electrode of the fourth transistor is electrically connected to the first end of the storage capacitor, and a second electrode of the fourth transistor is electrically connected to the second node;

a second end of the storage capacitor is electrically connected to the first node.

5. The pixel circuit according to claim 1, wherein the light emission control sub-circuit comprises a fifth transistor and a sixth transistor, wherein a gate of the fifth transistor is electrically connected to receive the first control signal, a first electrode of the fifth transistor is electrically connected to receive a first voltage signal, and a second electrode of the fifth transistor is electrically connected to the second node;

a gate of the sixth transistor is electrically connected to receive the first control signal, a first electrode of the sixth transistor is electrically connected to the third node, and a second electrode of the sixth transistor is electrically connected to the first node.

6. The pixel circuit according to claim 1, wherein the driving control sub-circuit comprises a seventh transistor, a gate of the seventh transistor is electrically connected to receive the second control signal, a first electrode of the seventh transistor is electrically connected to receive the compensation data signal, and a second electrode of the seventh transistor is electrically connected to the third node.

7. The pixel circuit according to claim 1, wherein the second compensation sub-circuit comprises a plurality of compensation capacitors which correspond to respective pixel driving circuits, and a first end of each of the compensation capacitors is electrically connected to the first node, and the second end of each of the compensation capacitors is electrically connected to the gate of the seventh transistor.

8. The pixel circuit according to claim 1, wherein the reset sub-circuit comprises an eighth transistor and a ninth transistor, wherein a gate of the eighth transistor is electrically connected to receive a third control signal, a first electrode of the eighth transistor is electrically connected to the first node, and a second electrode of the eighth transistor is electrically connected to the output terminal of the switching sub-circuit;

a gate of the ninth transistor is electrically connected to receive a fourth control signal, a first electrode of the ninth transistor is electrically connected to receive the first voltage signal, and a second electrode of the ninth transistor is electrically connected to the first end of the storage capacitor.

9. A display device comprising the pixel circuit according to claim 1.

10. A display method by using a display device comprising the pixel circuit according to claim 1, comprising:

generating the compensation data signal by using the first compensation sub-circuit of the pixel circuit; and driving the light-emitting element in each pixel unit to emit light based on the compensation data signal by using the pixel units of the pixel circuit.

11. The method according to claim 10, wherein, before driving the light-emitting element in each pixel unit to emit light, the first compensation sub-circuit generates the compensation data signal based on light-emitting brightness of a selected light-emitting element.

12. The method according to claim 10, wherein, in a process of driving the light-emitting element in each pixel unit to emit light, the first compensation sub-circuit generates the compensation data signal based on light-emitting brightness of the light-emitting element in each pixel unit.

13. A method for driving a pixel circuit, wherein the pixel circuit comprising:

a plurality of pixel units arranged in a matrix, wherein each pixel unit comprises a light-emitting element and a pixel driving circuit for driving the light-emitting element to emit light, and the pixel driving circuit and the light-emitting element are electrically connected to a first node;

a first compensation sub-circuit electrically connected to each pixel driving circuit in each of the plurality of pixel units, wherein the first compensation sub-circuit is configured to provide an initialization signal to the pixel driving circuit, and to obtain a voltage at the first node when the light-emitting element emits light via the pixel driving circuit, and to generate a compensation data signal based on the voltage at the first node; and a second compensation sub-circuit electrically connected to each pixel driving circuit in each of the plurality of pixel units and configured to keep the voltage at the first node within a set operating voltage range of the light-emitting element, wherein the pixel driving circuit is further configured to initialize the first node based on the initialization signal, and to use the compensation data signal to drive the light-emitting element to emit light, wherein the first compensation sub-circuit comprises:

a switching sub-circuit configured to receive a first switching signal and a second switching signal, and to output the initialization signal at an output terminal of the switching sub-circuit under the control of the first switching signal and keep the output terminal in a floating state under the control of the second switching signal;

a sampling sub-circuit configured to obtain the voltage at the first node while the output terminal is kept in the floating state; and a data compensation sub-circuit configured to generate the compensation data signal based on a preset compensation model and the voltage at the first node, wherein the method comprises:

compensating a threshold voltage of the pixel driving circuit, so as to eliminate influence of the threshold voltage on a current flowing through the light-emitting element;

generating the compensation data signal by using the first compensation sub-circuit; and driving the light-emitting element in each pixel unit to emit light based on the compensation data signal.

14. The method according to claim 13, wherein the compensation data signal is generated based on light-emitting brightness of a selected light-emitting element before driving the light-emitting element in each pixel unit to emit light.

15. The method according to claim 13, wherein, in a process of driving the light-emitting element in each pixel unit to emit light, the compensation data signal is generated based on light-emitting brightness of a light-emitting element in each of selected pixel units or based on the light-emitting brightness of the light-emitting element in each pixel unit.

16. The method according to claim 13, wherein generating the compensation data signal by using the first compensation sub-circuit comprises:

in a first sampling period, providing the second switching signal, a first control signal, and a third control signal which all have a first level, and providing the first switching signal, a sampling control signal, a second control signal, and a fourth control signal which all have a second level; and in a second sampling period, providing the second switching signal, the sampling control signal, the first control signal, and the third control signal which all have the first level, and providing the first switching signal, the second control signal, and the fourth control signal which all have the second level.

17. The method according to claim 13, wherein driving the light-emitting element in each pixel unit to emit light based on the compensation data signal comprises:

in a first driving period, providing the first switching signal, a third control signal, and a fourth control signal which all have the first level, and providing the second switching signal, a first control signal, and a second control signal which all have the second level;

in a second driving period, providing the first switching signal, the second control signal, and the third control signal which all have the first level, and providing the second switching signal, the first control signal, and the fourth control signal which all have the second level; and in a third driving period, providing the first switching signal and the first control signal which both have the first level, and providing the second switching signal, the second control signal, the third control signal, and the fourth control signal which all have the second level.

* * * * *